US005484365A

United States Patent [19]

Jones et al.

[11] Patent Number: 5,484,365

[45] Date of Patent: Jan. 16, 1996

[54] LEG PRESS EXERCISE MACHINE

[75] Inventors: Arthur A. Jones, Ocala; Philip Sencil, Anthony, both of Fla.

[73] Assignee: MedX Corporation, Ocala, Fla.

[21] Appl. No.: 60,657

[22] Filed: May 13, 1993

Related U.S. Application Data

[63] Continuation-in-part of Ser. No. 909,658, Jul. 7, 1992, Pat. No. 5,256,125, and a continuation-in-part of Ser. No. 921,112, Jul. 29, 1992, Pat. No. 5,338,274, and a continuation-in-part of Ser. No. 145, Jan. 4, 1993, Pat. No. 5,304,107, and a continuation-in-part of Ser. No. 20,807, Feb. 22, 1993, Pat. No. 5,342,270.

[51] Int. Cl.[6] ..... A63B 21/06; A63B 23/04

[52] U.S. Cl. ..... 482/97; 482/100; 482/137

[58] Field of Search ..... 482/97–103, 133–138

[56] References Cited

U.S. PATENT DOCUMENTS

| | | | |
|---|---|---|---|
| 3,588,101 | 6/1971 | Jungreis | 482/97 X |
| 3,708,166 | 1/1973 | Annas | 482/100 |
| 3,917,262 | 11/1975 | Salkeld | 482/98 |
| 4,149,714 | 4/1979 | Lambert, Jr. | 482/100 |
| 4,240,626 | 12/1980 | Lambert, Jr. | 482/100 |
| 4,500,089 | 2/1985 | Jones | 482/100 |
| 4,799,670 | 1/1989 | Williamson | 482/97 |
| 4,838,548 | 6/1989 | Maag | 482/137 X |
| 4,872,670 | 10/1989 | Nichols | 482/97 X |
| 4,964,632 | 10/1990 | Rockwell | 482/100 |
| 5,058,884 | 10/1991 | Fuller, Sr. | 482/97 |
| 5,106,081 | 4/1992 | Webb | 482/137 |

FOREIGN PATENT DOCUMENTS

| | | | |
|---|---|---|---|
| 244071 | 3/1987 | German Dem. Rep. | 482/97 |
| 244070 | 3/1987 | German Dem. Rep. | 482/97 |
| 279412 | 6/1990 | Germany | 482/97 |

*Primary Examiner*—Richard J. Apley
*Assistant Examiner*—John Mulcahy
*Attorney, Agent, or Firm*—William E. Mouzavires

[57] ABSTRACT

A leg press machine has a movement arm mounted by parallel links for pivotal movement about a generally horizontal axis in opposition to one or more resistance weight stacks on opposite sides of the movement arm. The linkage is connected to a drive lever below the movement arm which in turn is connected to the bottom of a weight stack rod to raise the latter and associated weights as the movement arm is pivoted by the legs. The movement arm is stabilized by the linkage and a counterweight connected to the linkage.

2 Claims, 4 Drawing Sheets

41
87
47
41
53
34
47
88
39
77
59a
57a
89
37
51
33
49
26a
24a
83
29
27
39
67
32
67

LEG PRESS EXERCISE MACHINE

RELATED APPLICATIONS

This application is a continuation-in-part of my prior applications which are as follows:

Ser. No. 07/909,658, filed Jul. 7, 1992, U.S. Pat. No. 5,256,125

Ser. No. 07/921,112, filed Jul. 29, 1992, U.S. Pat. No. 5,338,274

Ser. No. 08/000,145, filed Jan. 4, 1993, U.S. Pat. No. 5,304,107

Ser. No. 08/020,807, filed Feb. 22, 1993 U.S. Pat. No. 5,346,270

The disclosures of my aforementioned applications are hereby incorporated by reference into the subject application as part hereof.

BACKGROUND OF INVENTION

The present invention generally relates to exercise machines and more particularly to machines for exercising the various groups of muscles located in the legs including the quadriceps, "gluts", and hamstrings. Numerous machines exist and have been known in the prior art for exercising the aforementioned parts of the human body. Such machines commonly utilize some sort of a movement arm moved by the body upon exertion of the legs against a resistance, typically a weight stack. Commonly, the movement arm is connected to the weight stack by an overhead cable/chain and pulley system which increases the height of the machine and also introduces a certain amount of friction in the transmission of the drive thereby reducing efficiency. Examples of such machines are shown in U.S. Pat. Nos. 4,511,137 Jones and 5,135,457 Caruso.

Certain other types of machines of the prior art use "free" weights as opposed to a weight stack. Free weights are typically interchangeable about a member on the movement arm. An example of such a machine is shown in U.S. Pat. No. 4,509,746 Mask. Although useful, "free weight" machines have certain disadvantages in that it takes a certain amount of time and effort to change the weight each time a new repetition or exercise is to be performed. Also "free weights" are not always balanced and can subject the exerciser to jerky movements which may damage the muscles or lessen the efficiency of the exercise.

OBJECTS OF THE PRESENT INVENTION

An object of the present invention is to provide a novel and improved exercise machine which utilizes a weight stack for resistance to the movement arm but which eliminates the need of an overhead cable and pulley system for transmitting the drive from the movement arm to the weight stack.

A further object of the present invention is to provide novel and improved machines and methods for exercising one or more parts of the legs including, for example, the "gluts", quadriceps, and hamstrings in a manner which is safe and effective.

Another object of the present invention is to provide a novel leg press machine offering a wide range of weight selection to suit various strengths of its users. Another object of the present invention is to provide a leg press machine that has the capacity for high or low resistance exercise without sacrificing safety or efficiency of the machine.

Another object of the present invention is the provision of such a machine and methods which incorporate an improved drive system for transmitting movement from a movement arm to a resistance mechanism preferably a weight stack.

SUMMARY OF THE PREFERRED

In summary, the preferred embodiment of the present invention takes the form of a leg press machine and includes a movement arm pivotable about a generally horizontal axis by the user exerting the feet and legs against the movement arm while in a seated position. The movement arm includes a footrest or a footboard mounted to a linkage which is pivotable about a generally horizontal axis. The linkage is connected to a cable or chain trained about a pulley and connected to a second linkage including a lever which in turn is connected to a resistance preferably a weight stack. Additionally in the preferred embodiment, the lever is located below the movement arm and connected to the lower end of a weight stack. In the preferred embodiment there are two linkages and levers respectively interconnecting opposite sides of the footrest with two weight stacks on opposite sides of the machine. Pivoting of the movement arm in one direction by the user pressing the legs against the footrest will, through the linkage and lever, raise weights in one or both weight stacks. When the exerciser relieves force on the movement arm, the movement arm will pivot in the opposite direction while the resistance weights descend to the starting position. Also it is preferred that the lower end of the movement arm be provided with a counterweight to counterbalance the mass of the movement arm.

DRAWINGS

Other objects and advantages of the present invention will become apparent from the following more detailed description taken in conjunction with the attached drawings in which.

DETAILED DESCRIPTION

Figure 1:
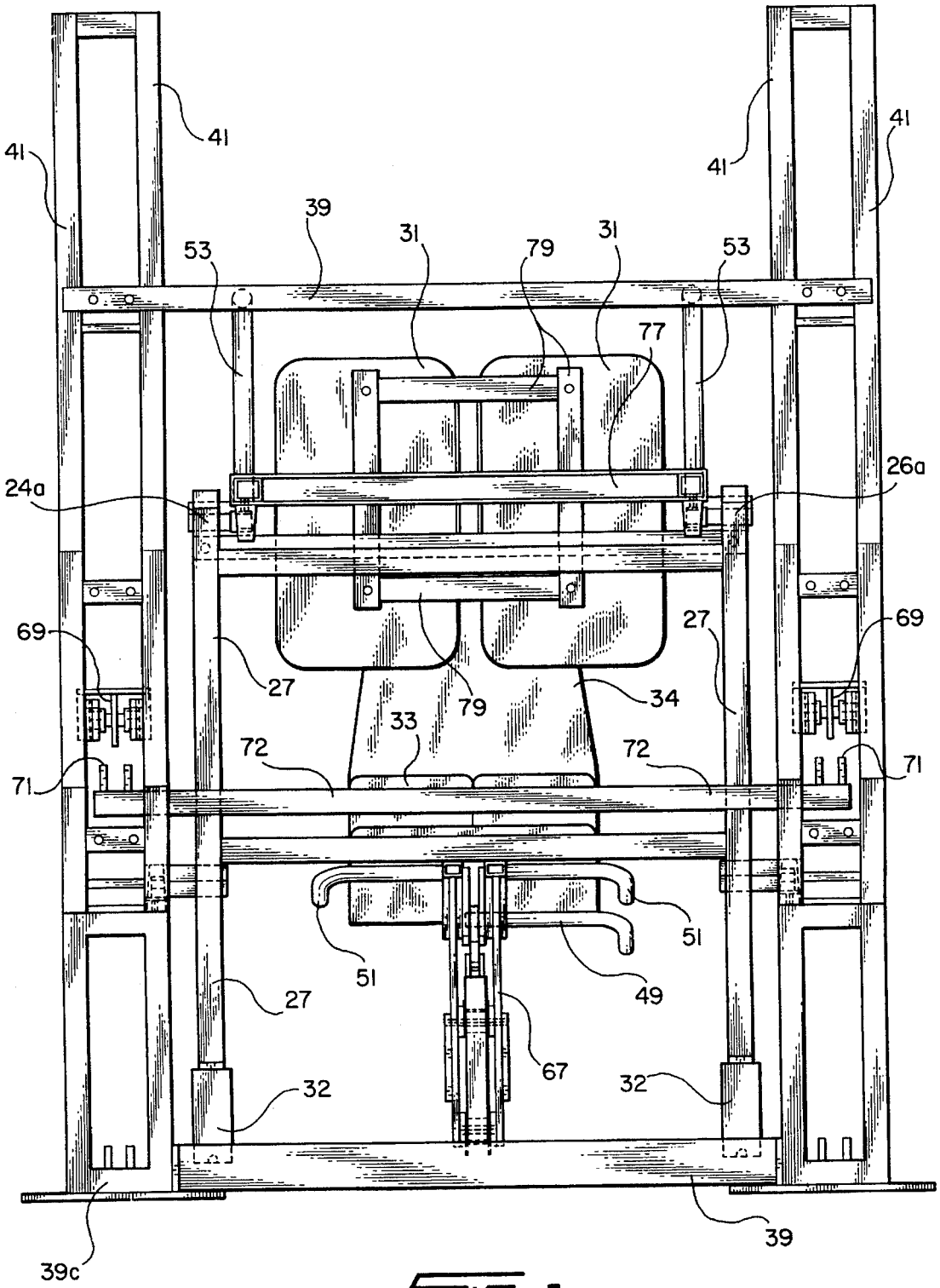
FIG. 1 is an elevational view of an exercise machine constituting a preferred embodiment of the present invention as seen from the front end thereof.
Figure 2:
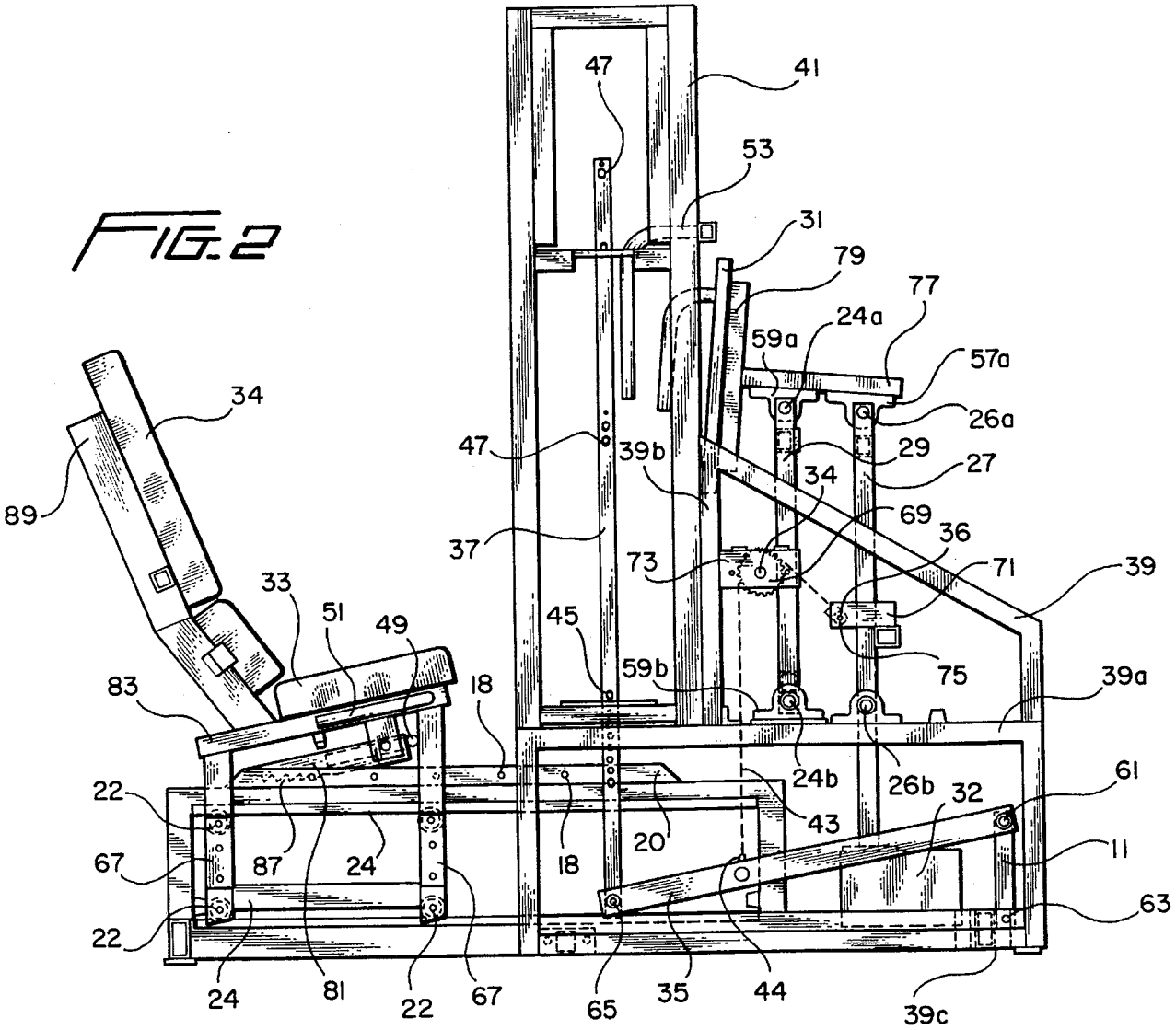
FIG. 2 is a side elevational view of the machine taken from the right side thereof and with a footboard in starting position.

Referring now to the drawings in detail, there is shown for illustrative purposes only a machine embodying the present invention and which may be termed a "leg press" machine for exercising groups of muscles located in the legs, mainly the quadriceps, "gluts", and hamstrings. Referring initially to FIGS. 1 and 2, in the preferred embodiment shown, the machine includes a primary frame generally designated 39 and two side frames generally designated 41 on opposite sides of the primary frame for housing two weight stacks to be described below. The frames are made from elongated rails or tubular stock of high strength metallic material, however any other suitable material may be utilized as long as it provides the necessary strength and weight.

Figure 3:
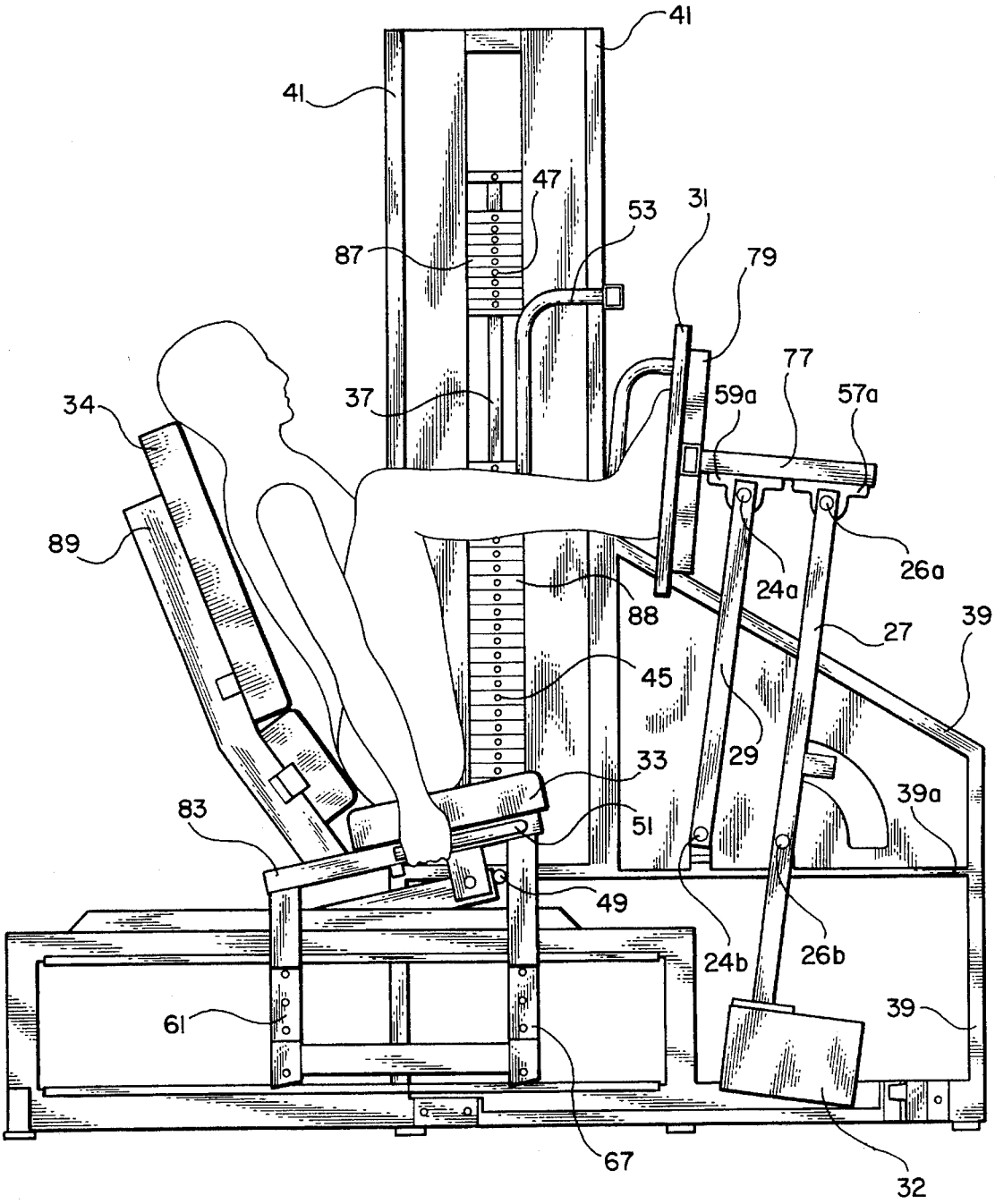
FIG. 3 is a side elevational view generally similar to FIG. 2 but also showing a seated user in the start position of an exercise and with portions of the machine removed.
Figure 4:
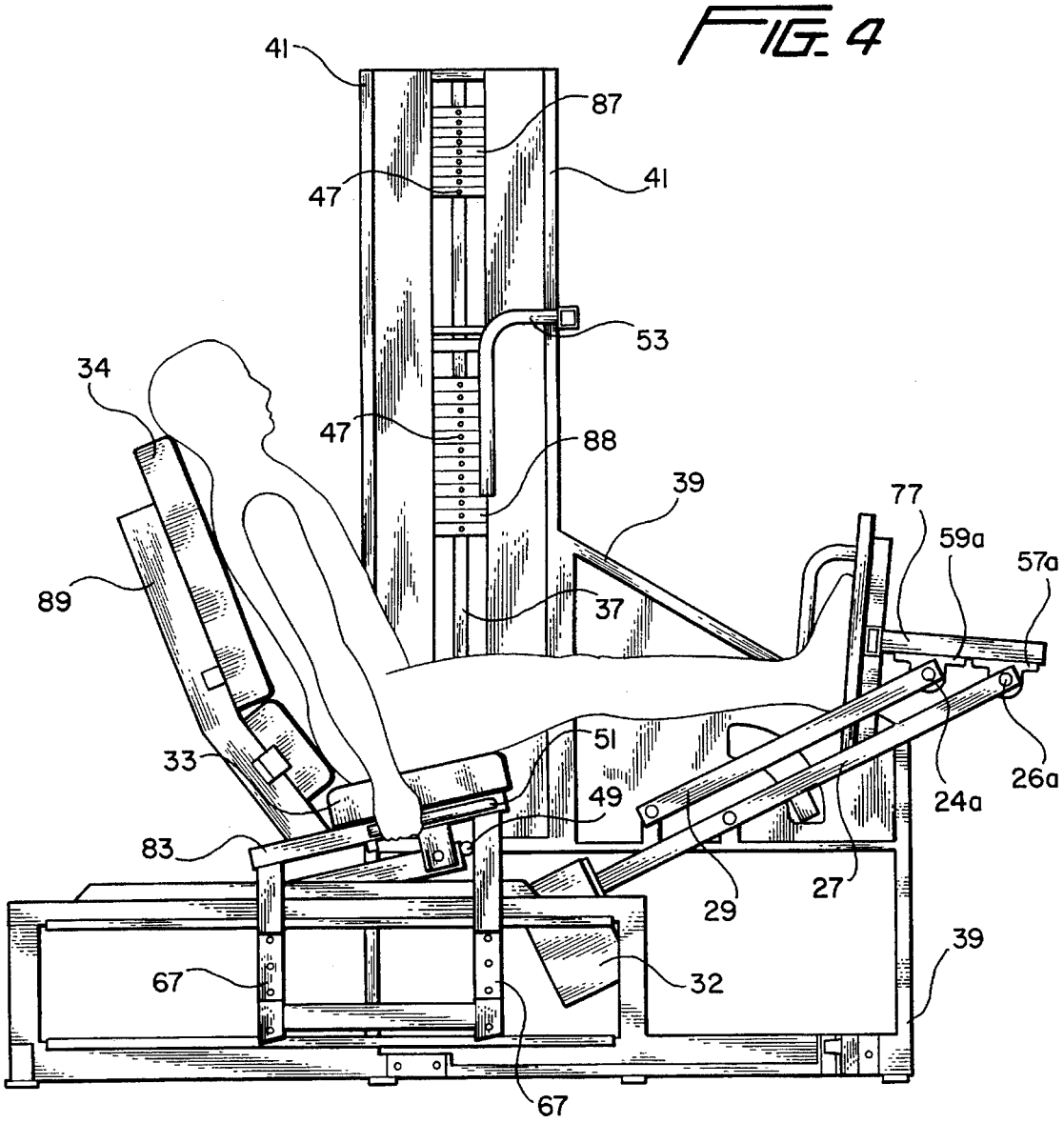
FIG. 4 is a side elevational view generally similar to FIG. 3 but showing the user in an extended-leg position.

Primary frame 39 supports a seat generally designated 33 mounted to the frame by vertical legs designated 67. The seat 33 itself is mounted on base 83 which in turn is affixed to the legs 67. For horizontal adjustment of the seat 33 (i.e. front to rear and vice versa) a lever actuating handle 49 is provided under base plate 83 which when raised to an upright position allows seat-adjustment ridges 87 on the lever to be raised from pins 18 spaced along frame member 20. This allows the seat 33 to be adjusted forwardly or rearwardly. In the preferred embodiment wheels 22 are mounted on the legs 67 of seat 33 and ride in tracks 24 which are part of the frame 39 as shown in FIG. 2. Once the seat is adjusted, lever 49 is released to engage one of the ridges 87 on one of the pins 18 to lock the seat in adjusted position. On each side of the bottom portion of seat 33 can be seen user stabilization grip handles 51 fixed to the seat to be held by the user as shown in FIGS. 3 and 4. Seat 33 also has a backrest portion 34 affixed to a support frame 89 as best shown in FIG. 2.

To exercise the leg muscles, the user sits on seat 33 as shown in FIG. 3 and places his feet, with knees bent toward the chest, against a movement arm shown as including a footboard 31. In the specific embodiment shown, footboard 31 is comprised of two separate foot pads 31 fixed to a rectangular support frame 79, as shown in FIG. 1, thus uniting boards 31 as one board. Support frame 79, in turn, is connected to a linkage member including a link 77, shown in FIG. 2 as extending forwardly generally at right angles from frame 79, and being fixed to the latter. The linkage further includes a pair of parallel links 27, 29 pivotably connected by pivots **26*a*, 24*a* and bearing blocks 57*a*, 59*a* to link 77 as shown in FIGS. 2 and 3. The lower end portions of parallel links 27, 29 are pivotably mounted to frame portion 39*a* by pivot pins 24*b* and 26*b*. Link 27 extends below pivot 26*b* where it is fixed to a counterbalance weight 32 shown in FIG. 2 and preferably being 30 to 40 lbs in weight. In the preferred embodiment there are two movement arm linkages 27, 29 on each side of and connected to the footboard as best shown in FIG. 1**.

In accordance with another aspect of the present invention, a novel drive system is provided to transmit movement of the movement arm 31, 77, 27, 29 to a resistance, preferably a weight stack. In the preferred embodiment shown in FIG. 2 the drive system includes a generally vertical drive-chain or cable designated 43 which is connected to link 27 at 36, and trained about a pulley or sprocket wheel 69 mounted on a bracket 73, via pin 34 as shown in FIG. 4. Bracket 73 in turn is fixed to frame portion **39*b*. A bracket 71 is used to connect the chain to link 27**.

As there are two drive systems on each side of the footboard 31, bracket 71 is fixed to a crossbar 72 extending across and fixed to links 27 as shown in FIG. 1. Since the drive systems are identical, only the one on the left side shown in FIG. 4 will be further described. As shown in FIG. 2, drive chain 43 extends downwardly to the frame portion **39*c* (FIG. 1) on one side where it is connected to a main drive lever 35 intermediate the ends thereof. Drive lever 35 in the preferred embodiment is mounted to the frame 39*c* by a link 11 having its upper end pivotally connected at pivot 61 to the forward end of link 35 and having its lower end pivotally mounted to frame 39*c* by pivot pin 63. The rear end of drive lever 35 is pivotally connected to the lower end of a weight stack rod 37 by pivot pin 65**.

Any suitable resistance weight stack may be employed, however in the preferred embodiment a compound weight stack is utilized such as disclosed in my U.S. Pat. No. 4,834,365 entitled COMPOUND WEIGHT SYSTEM. The disclosure of my aforementioned U.S. Pat. No. 4,834,365 as well as my co-pending application, Ser. No. 07/813,531 identified above, are hereby incorporated by reference into the instant application as part thereof. In the instant embodiment, the compound weight stack includes a frame 41 including first and second independent groups of weights 87 and 88 as shown in FIG. 3. The upper and lower groups of weights 87 and 88 are connectable to the stack rod 37 through means of apertures 47 in the rod 37 which receive pins extending through the weights in well-known manner. One or more weights in each group may be connected to stack rod 37 independently of the weights of the other group. Upper weights 87 each may be for example 21 lbs. and lower weights 20lbs. The total weight capacity of each weight stack in the preferred embodiment is about 600 lbs. Moreover one or both weight stacks on opposite sides of the machine may be connected to the movement arm thus providing a great range of preselectable weights available to the user.

In operation, as a user places the feet against footboard 31 and proceeds to push outward from the initial crouched starting position (shown in FIG. 3) the footboard 31 moves outward and movement arm 77 moves forward in a generally horizontal plane (as shown in FIG. 4) as the parallel links 27, 29 pivot forwardly about pivots **26*b*, 24*b*. Because of the use of a plurality of links 27, 29 and the counterweight 32 connected to link 27, the movement of the footboard 31 by the exerciser is stabilized. In addition the counterweight allows a direct correlation between the resistance weight selected by the user and the actual resistance force provided during exercise. As link 27 is pivoted fowardly, drive-chain 43 is pulled forward by link 27 about sprocket 69, thus raising chain 43 and in turn the drive lever 35 until the legs are fully extended as shown in FIG. 4. Raising chain 43 of course raises the stack rod 37 and the weights connected thereto which thus serve to provide the desired resistance to the muscles being exercised. When the user releases pressure on the footboard 31, the resistance weights will descend to return the footboard to the starting position. The exercise is repeated as desired. In the preferred embodiment the maximum stroke or distance of movement of the weights and rod 37 is twelve inches (12") which insures that the descending weights can be safely handled by the user during the return stroke. When the user leaves the machine, the movement arm linkage 27, 29 will be stabilized in the vertical position shown in FIG. 2**. One or both legs may be exercised in the foregoing manner with one or both weight stacks.

It will be seen that the present invention provides exercise machines with extremely low friction in the transmission between the movement arm and the weight stack thus increasing the efficiency of the machine. In addition, the height of the machine of the present invention may be reduced while the weight capacity of the resistance weights is greatly increased. Furthermore, the machine of the present invention allows easy use of the machine by affording direct access to the seat and the resistance weight stack which because of the compound weight stacks on both sides, allows weight selection in small increments, for example 2 pound increments or large increments up to 1200 lbs.

Although a specific embodiment of the invention has been shown and described above, the scope of the present invention is not limited to the specific embodiment shown but rather is covered by the attached claims appearing below.

What is claimed is:

1. A leg press machine comprising in combination, a footrest mounted for movement about a generally horizontal axis in response to engagement by the legs of an exerciser, resistance means for opposing movement of the footrest in one direction about said axis, transmission means including a pair of generally parallel links connecting the footrest to said resistance means for transmitting movement from the footrest to the resistance means, and a counterweight located below said axis and fixed to one of said generally parallel links, said counterweight biasing said links and said footrest to extend in generally vertical planes, and wherein said resistance includes a pair of weight stacks respectively located on opposite sides of the footrest, each weight stack including a rod and one or more weights connected to the rod and said transmission means includes a pair of levers respectively located on opposite sides of the footrest below the weights and pivotally connected to the rods to raise the rods when the footrest is moved in said one direction, and wherein the transmission means further includes two pairs of said generally parallel links respectively located on opposite sides of said footrest and connected to the footrest and said levers.

2. A leg press machine comprising in combination, a footrest mounted for movement about a generally horizontal axis in response to engagement by the legs of an exerciser, resistance means for opposing movement of the footrest in one direction about said axis, transmission means including a pair of generally parallel links connecting the footrest to said resistance means for transmitting movement from the footrest to the resistance means, and a counterweight located below said axis and fixed to one of said generally parallel links, said counterweight biasing said links and said footrest to extend in generally vertical planes, and wherein said resistance means includes a weight stack including a rod and one or more weights connected to the rod, and said transmission means includes a lever below the weights and pivotally connected to the rod to raise the rod when the footrest is moved in said one direction.

* * * * *